US008115128B2

(12) United States Patent
Yang

(10) Patent No.: US 8,115,128 B2
(45) Date of Patent: Feb. 14, 2012

(54) MULTIFUNCTION WALL SWITCH

(76) Inventor: Kevin Yang, Lomita, CA (US)

( * ) Notice: Subject to any disclaimer, the term of this patent is extended or adjusted under 35 U.S.C. 154(b) by 324 days.

(21) Appl. No.: 12/629,214

(22) Filed: Dec. 2, 2009

(65) Prior Publication Data

US 2011/0127151 A1 Jun. 2, 2011

(51) Int. Cl.
*H01H 9/26* (2006.01)

(52) U.S. Cl. ..... 200/330; 200/1 B; 200/331; 200/339

(58) Field of Classification Search ..... 200/1 B, 200/4, 5 B, 17 R, 18, 43.04, 43.16, 50.06, 200/50.4, 520, 553, 297, 329–332, 333, 339, 200/341, 343, 5 C, 50.32, 50.37, 334; 174/66, 174/67; 307/125; 315/292, 294, 297, 320, 315/129, 133
See application file for complete search history.

(56) References Cited

U.S. PATENT DOCUMENTS 4,359,619 A * 11/1982 Bergoltz ..... 200/333
4,939,383 A * 7/1990 Tucker et al. ..... 307/139
5,359,231 A * 10/1994 Flowers et al. ..... 307/125
7,170,018 B2 * 1/2007 Ilkhanov ..... 200/18
7,365,282 B2 * 4/2008 Altonen et al. ..... 200/331
7,465,895 B2 * 12/2008 Yoshida ..... 200/310
7,985,937 B2 * 7/2011 Wu et al. ..... 200/330
2009/0189542 A1 * 7/2009 Wu et al. ..... 315/294
2010/0101924 A1 * 4/2010 Wu et al. ..... 200/339
2010/0126839 A1 * 5/2010 Basilico ..... 200/339

* cited by examiner

*Primary Examiner* — Michael Friedhofer
(74) *Attorney, Agent, or Firm* — Clement Cheng

(57) ABSTRACT

A multifunction switch has a switch body; a main switch toggle rotationally mounted to the switch body for controlling completion of an electric circuit. The main switch toggle has an on position and an off position. A toggle switch button is mounted to the main switch toggle. The toggle switch button is generally planar. A secondary switch button is mounted to the toggle switch button. A secondary switch is mounted to the switch body. The secondary switch is mounted adjacent to the main switch toggle. A generally planar faceplate has a switch button opening. The switch button opening is sized to receive the toggle switch button. An offset gap is formed when the toggle switch button is moved to the main switch off position.

12 Claims, 3 Drawing Sheets

MULTIFUNCTION WALL SWITCH

FIELD OF THE INVENTION

This invention relates to the field of electrical switches and controls.

DISCUSSION OF RELATED ART

The traditional wall switch has connection for connecting to a circuit for completing a circuit to a light element such as a lamp. The traditional wall switch is wired by a hot terminal and has only a pair of connection terminals. The wall switch architectural type has been modified from the traditional toggle to a Decora style faceplate and button configuration, however the basic functionality has remained the same.

Subsequently, other dimmer switches allowed modification of the voltage and power for providing dimming lights. Some of the dimmer switches were styled as dials or sliders which provide a continuously variable dimming feature on light elements. These dimmer switches also are able to control a variety of incandescent, LED and fluorescent lighting. Oftentimes, a plurality of switches are mounted on a single wall control to provide multiple controls integrated in a single location. As a result, a variety of combined switch and dimmer switches have been invented, and have varying degrees of functionality.

SUMMARY OF THE INVENTION

A multifunction switch has a switch body; a main switch toggle rotationally mounted to the switch body for controlling completion of an electric circuit. The main switch toggle has an on position and an off position. A toggle switch button is mounted to the main switch toggle. The toggle switch button is generally planar. A secondary switch button is mounted to the toggle switch button. A secondary switch is mounted to the switch body. The secondary switch is mounted adjacent to the main switch toggle. A generally planar faceplate has a switch button opening. The switch button opening is sized to receive the toggle switch button. An offset gap is formed when the toggle switch button is moved to the main switch off position. The offset gap deactivates the ability to activate the secondary switch via the secondary switch button. The offset gap is eliminated when the toggle switch button is moved to the main switch on position so that a user may press the secondary switch button for actuating the secondary switch. The main switch toggle is rotated to an off position that renders the secondary switch button out of actuation contract with the secondary switch. Only when the main switch toggle is in the on position can the secondary switch button rotate toward the secondary switch such that a user pressing on the secondary switch button will actuate the secondary switch. The secondary switch button is mounted to an inside of the toggle switch button via the spring which can be a leaf spring.

Preferably, a faceplate side has thickness substantially enough to cover an edge of the main switch body. The secondary switch button should be mounted to an inside of the toggle switch button via a serpentine shaped leaf spring. The multifunction switch should have a light element that shines from the secondary switch through the secondary switch button via a light window for viewing by a viewer, so the toggle switch button has a front side and a rear side, and the front side has the secondary switch button mounted in an opening for the secondary switch button. Also, it is preferred to have a plurality of modes that cycle upon each activation of the secondary switch, wherein the modes include various levels of dimming of a light. It is also preferred to include an inside well formed as a depression on the back side of the toggle switch button. The inside well has an upper protrusion and a lower protrusion. The upper protrusion fits into a main switch upper slot and the lower protrusion fits into a main switch lower slot, such that when the user presses and rotates the toggle switch button. The toggle switch button is connected to the main switch toggle and therefore actuates the main switch toggle.

The invention is a double action switch. The first action is turning on and off. The second action is dimming and brightening either in a continuously variable fashion or in discreet steps.

The square shaped version of the present invention is the preferred embodiment of the invention. The double action switch includes a generally planar faceplate face that has a switch button opening inside the balance of the faceplate face. The faceplate face also has a faceplate side of thickness substantially enough to cover the edge of the main switch body. The switch body is mounted to a socket opening flush on the wall with the main switch body edge extending into the room. The main switch body further includes a first rectangular opening area that is the main switch mounting area and a second rectangular opening area that is the secondary switch mounting area. The main switch toggle and the main switch toggle assembly is mounted in the main switch mounting area. The second switch mounting area receives the secondary switch. The secondary switch is preferably placed adjacent to the main switch toggle at a lower right-hand corner for the orientation where the switch is on in the down position.

When the main switch toggle rotates relative to the switch body, the primary or main switch toggle activates or turns on or turns off the lights or other appliance. The main switch toggle affects the ability to activate the secondary switch. The secondary switch is not active when the main switch toggle is in the off position. The secondary switch is only active when the main switch toggle is in the on position.

When the main switch toggle is in the on position, the secondary switch button is rotated toward the secondary switch such that a finger pressing on the secondary switch button will press and activate or deactivate the secondary switch. The secondary switch preferably has various modes that cycle upon each activation of the secondary switch. The main switch toggle can be rotated to an off position where the secondary switch button is out of contract with the secondary switch.

The toggle switch button has a front side and a rear side. The front side has a secondary switch button mounted in an opening for the secondary switch button. The rear side of the toggle switch button includes a light indicator window for a light indicator such as an LED to show the status of the secondary switch. The light indicator may flash in a particular sequence or be bright, dim and off to show the various states that the secondary switch can cycle through. The secondary switch can dim the primary switch by altering voltage, or sending a power line signal to intelligent ballast capable of receiving such signals from the secondary switch.

The secondary switch button is mounted to the inside of the toggle switch button via a spring apparatus that can be a plastic serpentine leaf spring as shown, or can be a metal leaf spring. The light indicator may be mounted on the leaf spring which is partially transparent, or the light indicator can be mounted on the face of the secondary switch so that the light shines from the secondary switch to the secondary switch button and passing through the secondary switch button window for viewing by a viewer.

The toggle switch button further has an inside well formed as a depression on the back side of the toggle switch button. The inside well holds an upper protrusion and a lower protrusion. The upper protrusion fits into a main switch upper slot and the lower protrusion fits into a main switch lower slot. When the user presses and rotates the toggle switch button, the toggle switch button is connected to the main switch toggle and therefore actuates the main switch toggle. The face of the toggle switch button covers from view a portion of the switch body and the main switch toggle as well as the secondary switch.

Figure 1:
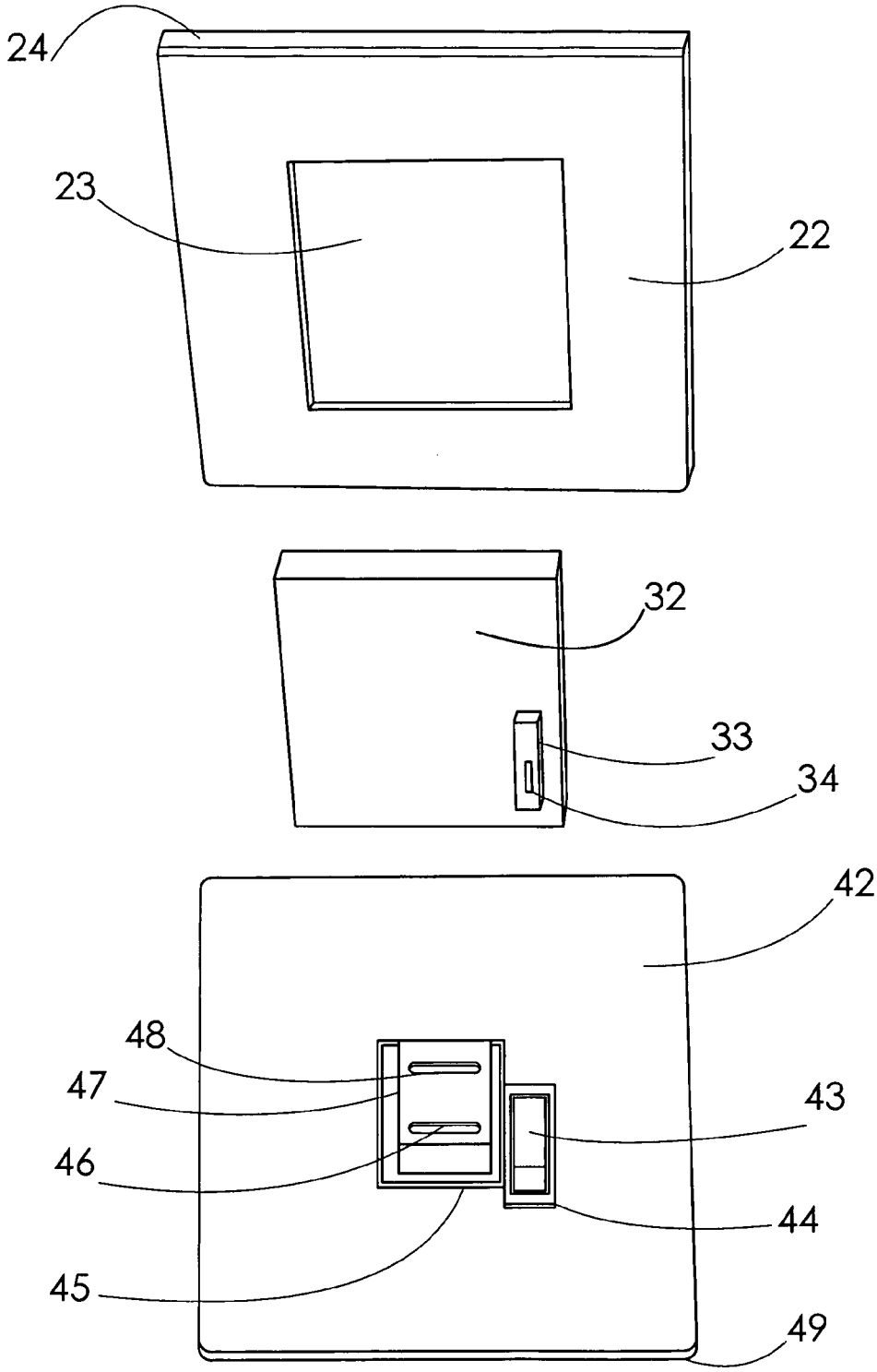
FIG. 1 is an exploded view of the present invention.
Figure 2:
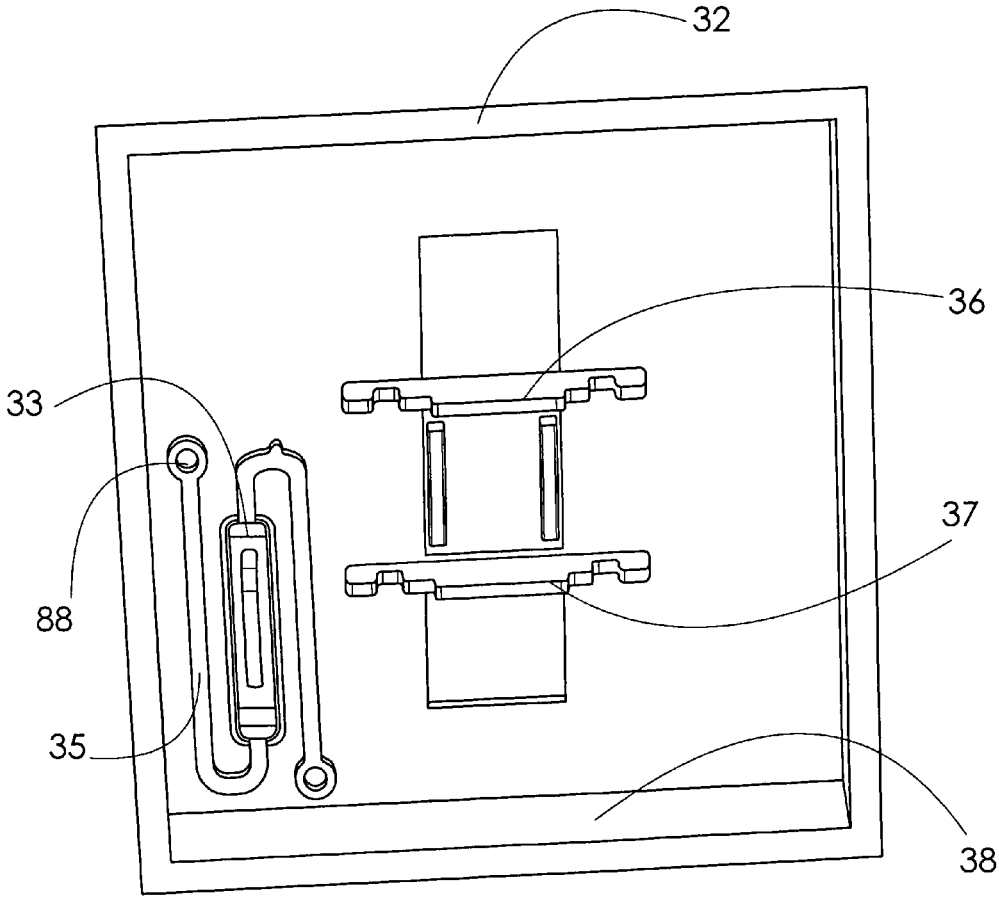
FIG. 2 is a rear view of the toggle switch button.

The following call out list of elements is used consistently in the drawings

22 Faceplate Face
23 Switch Button Opening
24 Faceplate Side
32 Toggle Switch Button
33 Secondary Switch Button
34 Light Indicator
35 Spring Apparatus
36 Upper Protrusion
37 Lower Protrusion
38 Inside Well
42 Switch Body
43 Secondary Switch
44 Secondary Switch Mounting Area
45 Main Switch Mounting Area
46 Main Switch Bottom Slot
47 Main Switch Toggle
48 Main Switch Upper Slot
49 Main Switch Body Edge
88 Spring Mounting

DETAILED DESCRIPTION OF THE PREFERRED EMBODIMENT

The square shaped exploded view of the present invention, as seen in FIG. 1 is the preferred embodiment of the invention. The double action switch includes a generally planar faceplate face 22 that has a switch button opening 23 inside the balance of the faceplate face. The faceplate face also has a faceplate side of thickness substantially enough to cover the edge 49 of the main switch body. The switch body 42 is mounted to a socket opening flush on the wall with the main switch body edge 49 extending into the room. The main switch body 42 further includes a first rectangular opening area that is the main switch mounting area 45 and a second rectangular opening area that is the secondary switch mounting area 44. The main switch toggle 47 and the main switch toggle assembly is mounted in the main switch mounting area 45. The second switch mounting area 44 receives the secondary switch 43. The secondary switch 43 is preferably placed adjacent to the main switch toggle 47 at a lower right-hand corner for the orientation where the switch is on in the down position.

Figure 3:
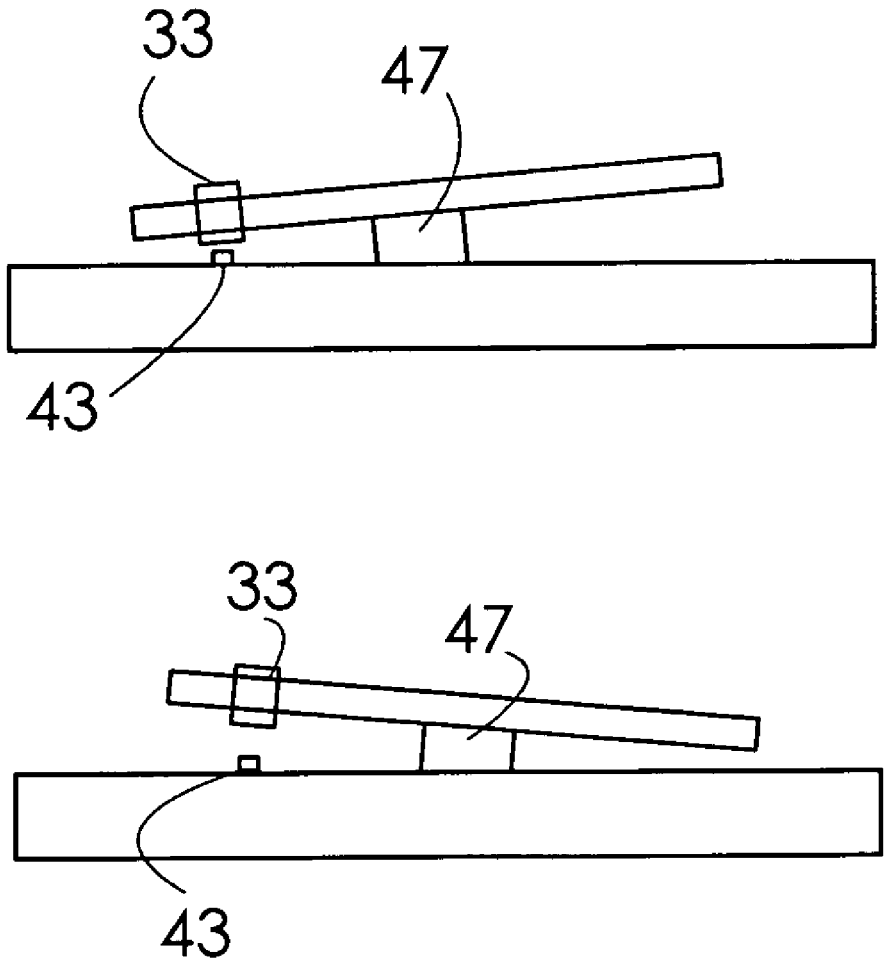
FIG. 3 is a side view diagram of the present invention.

When the main switch toggle rotates relative to the switch body 42, the primary or main switch toggle 47 activates or turns on or turns off the lights or other appliance. As seen in FIG. 3, the main switch toggle affects the ability to activate the secondary switch. The secondary switch 43 is not active when the main switch toggle is in the off position. The secondary switch is only active when the main switch toggle is in the on position.

When the main switch toggle is in the on position, the secondary switch button 33 is rotated toward the secondary switch 43 such that a finger pressing on the secondary switch button will press and activate or deactivate the secondary switch 43. The secondary switch 43 preferably has various modes that cycle upon each activation of the secondary switch 43. The main switch toggle 47 can be rotated to an off position where the secondary switch button 33 is out of contract with the secondary switch 43.

The toggle switch button 32 has a front side and a rear side. The front side has a secondary switch button 33 mounted in an opening for the secondary switch button. The rear side of the toggle switch button includes a light indicator window for a light indicator 34 such as an LED to show the status of the secondary switch. The light indicator may flash in a particular sequence or be bright, dim and off to show the various states that the secondary switch can cycle through. The secondary switch can dim the primary switch by altering voltage, or sending a powerline signal to an intelligent ballast capable of receiving such signals from the secondary switch.

The secondary switch button 33 is mounted to the inside of the toggle switch button 32 via a spring apparatus 35 which can be a plastic serpentine leaf spring as shown, or can be a metal leaf spring. The light indicator may be mounted on the leaf spring which is partially transparent, or the light indicator can be mounted on the face of the secondary switch 43 so that the light shines from the secondary switch 43 to the secondary switch button 33 and passing through the secondary switch button window for viewing by a viewer. Spring mounting 88 connects the spring of the secondary switch button to the toggle switch button 32.

The toggle switch button 32 further has an inside well 38 which is a depression on the back side of the toggle switch button. The inside well holds an upper protrusion 36 and a lower protrusion 37. The upper protrusion 36 fits into a main switch upper slot 48 and the lower protrusion 37 fits into a main switch lower slot 46. When the user presses and rotates the toggle switch button 32, the toggle switch button 32 is connected to the main switch toggle and therefore actuates the main switch toggle 47. The face of the toggle switch button 32 covers from view a portion of the switch body 42 and the main switch toggle 47 as well as the secondary switch 43.

As shown in FIG. 3 such as seen in the top diagram, the gap between the secondary switch button 33 and the secondary switch 43 can be small. After a user depresses the secondary switch button 33 in the on position which is the top drawing of FIG. 3, the gap is closed and the button translates downward in a sliding or pivoting motion for transmitting the force of a user finger via the secondary switch button 33 to the secondary switch 43. In the bottom drawing of FIG. 3, the main switch toggle 47 is in the off position having been pivoted to the off position. In this position, a user pressing the secondary switch button 33 would rotate the main switch toggle 47 into the on position. If the user then he is continuing to press with a finger for example, the user would bias secondary switch button 33 against the secondary switch 43.

During assembly, the lower and upper protrusions can act as tabs that snap into and out of the respective slotted openings. It is preferred that the main switch toggle 47 have a detent to retain it in the on or off position. It is optional that the main switch toggle 47 be actuated with a click sound when biased away from the biasing detent.

The invention claimed is:

1. A multifunction switch comprising:

a. a switch body;

b. a main switch toggle rotationally mounted to the switch body and controlling completion of an electric circuit; wherein the main switch toggle has an on position and an off position;

c. a toggle switch button mounted to the main switch toggle, wherein the toggle switch button is generally planar;

d. a secondary switch button mounted to the toggle switch button;

e. a secondary switch mounted to the switch body, wherein the secondary switch is mounted adjacent to the main switch toggle;

f. a generally planar faceplate having a switch button opening, wherein the switch button opening is sized to receive the toggle switch button; and g. an offset gap formed when the toggle switch button is moved to the main switch off position, wherein the offset gap deactivates the ability to activate the secondary switch via the secondary switch button, wherein the offset gap is eliminated when the toggle switch button is moved to the main switch on position so that a user may press the secondary switch button for actuating the secondary switch, wherein when the main switch toggle is rotated to an off position the secondary switch button is out of actuation contract with the secondary switch, whereby only when the main switch toggle is in the on position can the secondary switch button rotate toward the secondary switch such that a user pressing on the secondary switch button will actuate the secondary switch.

2. The multifunction switch of claim 1, further comprising a faceplate side of thickness substantially enough to cover an edge of the main switch body.

3. The multifunction switch of claim 1, wherein the secondary switch button is mounted to an inside of the toggle switch button via a spring.

4. The multifunction switch of claim 1, further comprising a light element that shines from the secondary switch through the secondary switch button via a light window for viewing by a viewer, wherein the toggle switch button has a front side and a rear side, wherein the front side has the secondary switch button mounted in an opening for the secondary switch button.

5. The multifunction switch of claim 1, further comprising a plurality of modes that cycle upon each activation of the secondary switch, wherein the modes include various levels of dimming of a light.

6. The multifunction switch of claim 1, further comprising an inside well formed as a depression on the back side of the toggle switch button, wherein the inside well has an upper protrusion and a lower protrusion, wherein the upper protrusion fits into a main switch upper slot and the lower protrusion fits into a main switch lower slot, such that when the user presses and rotates the toggle switch button, the toggle switch button is connected to the main switch toggle and therefore actuates the main switch toggle.

7. A multifunction switch comprising:

a. a switch body;

b. a main switch toggle rotationally mounted to the switch body and controlling completion of an electric circuit; wherein the main switch toggle has an on position and an off position;

c. a toggle switch button mounted to the main switch toggle, wherein the toggle switch button is generally planar;

d. a secondary switch button mounted to the toggle switch button;

e. a secondary switch mounted to the switch body, wherein the secondary switch is mounted adjacent to the main switch toggle;

f. a generally planar faceplate having a switch button opening, wherein the switch button opening is sized to receive the toggle switch button; and g. an offset gap formed when the toggle switch button is moved to the main switch off position, wherein the offset gap deactivates the ability to activate the secondary switch via the secondary switch button, wherein the offset gap is eliminated when the toggle switch button is moved to the main switch on position so that a user may press the secondary switch button for actuating the secondary switch, wherein when the main switch toggle is rotated to an off position the secondary switch button is out of actuation contract with the secondary switch, whereby only when the main switch toggle is in the on position can the secondary switch button rotate toward the secondary switch such that a user pressing on the secondary switch button will actuate the secondary switch; and h. a spring, wherein the secondary switch button is mounted to an inside of the toggle switch button via the spring, wherein the spring is a leaf spring.

8. The multifunction switch of claim 7, further comprising a faceplate side of thickness substantially enough to cover an edge of the main switch body.

9. The multifunction switch of claim 7, wherein the secondary switch button is mounted to an inside of the toggle switch button via a serpentine shaped leaf spring.

10. The multifunction switch of claim 7, further comprising a light element that shines from the secondary switch through the secondary switch button via a light window for viewing by a viewer, wherein the toggle switch button has a front side and a rear side, wherein the front side has the secondary switch button mounted in an opening for the secondary switch button.

11. The multifunction switch of claim 7, further comprising a plurality of modes that cycle upon each activation of the secondary switch, wherein the modes include various levels of dimming of a light.

12. The multifunction switch of claim 7, further comprising an inside well formed as a depression on the back side of the toggle switch button, wherein the inside well has an upper protrusion and a lower protrusion, wherein the upper protrusion fits into a main switch upper slot and the lower protrusion fits into a main switch lower slot, such that when the user presses and rotates the toggle switch button, the toggle switch button is connected to the main switch toggle and therefore actuates the main switch toggle.

* * * * *